US007082735B2

(12) United States Patent
Ramsey

(10) Patent No.: US 7,082,735 B2
(45) Date of Patent: Aug. 1, 2006

(54) BALUSTER, BALUSTRADE, AND METHOD THEREFOR

(75) Inventor: David M. Ramsey, Naples, FL (US)

(73) Assignee: Coffman Stairs, LLC, Marion, VA (US)

( * ) Notice: Subject to any disclaimer, the term of this patent is extended or adjusted under 35 U.S.C. 154(b) by 8 days.

(21) Appl. No.: 10/413,248

(22) Filed: Apr. 14, 2003

(65) Prior Publication Data

US 2004/0201006 A1 Oct. 14, 2004

(51) Int. Cl.
*E04H 17/00* (2006.01)

(52) U.S. Cl. ..... 52/720.2; 52/721.5; 52/184; 52/183

(58) Field of Classification Search ..... 52/720.2, 52/721.5, 183, 182, 184; 256/19, 22, 1
See application file for complete search history.

(56) References Cited

U.S. PATENT DOCUMENTS 2,558,142 A 6/1951 Lapp et al.
2,969,955 A 1/1961 Newman
3,200,554 A * 8/1965 Goodman et al. ..... 52/720.2
4,017,918 A * 4/1977 Harris ..... 5/100
4,386,761 A 6/1983 Kato
5,437,433 A 8/1995 Rezek
5,626,331 A * 5/1997 Erwin ..... 256/59
5,876,021 A * 3/1999 Spence et al. ..... 256/19
6,055,690 A * 5/2000 Koenig ..... 5/724
6,115,985 A * 9/2000 Wu ..... 52/720.2
6,125,598 A * 10/2000 Lanphier ..... 52/182
6,240,698 B1 * 6/2001 Chung ..... 52/720.2
6,311,957 B1 * 11/2001 Driscoll et al. ..... 256/65.05

* cited by examiner

*Primary Examiner*—Carl D. Friedman
*Assistant Examiner*—Basil Katcheves
(74) *Attorney, Agent, or Firm*—Alston & Bird LLP

(57) ABSTRACT

A baluster, balustrade, and method for constructing the same are provided. The balustrade includes a rail supported by one or more balusters, each baluster extending from a support surface such as one or more treads of stairs. Each baluster has an elongate member having a terminus portion and an end member that receives the terminus portion. The terminus portion is structured to be shortened, and the end member is selectively positionable on the terminus portion, such that the baluster is aesthetically configurable to accommodate stairs of varying dimensions.

12 Claims, 10 Drawing Sheets

BALUSTER, BALUSTRADE, AND METHOD THEREFOR

BACKGROUND OF THE INVENTION

1) Field of the Invention

The present invention relates to balusters for forming balustrades, such as are used for guardrails or handrails on staircases, balconies, verandas, and ramps. More particularly, the present invention relates to aesthetically configurable balusters that are modified to accommodate stairs of different dimensions.

2) Description of Related Art

Balustrades are often formed of a number of balusters that extend vertically to support a rail on a staircase, balcony, veranda, or ramp. The balusters are commonly formed with either a pin top or a square top. Pin top balusters have a circular cross-sectional shape at the top, which can be inserted into a corresponding aperture defined by the underside of the rail to connect the baluster to the rail. The depth of the aperture for a pin top baluster can vary, but is typically about one inch. Square top balusters have a square cross-sectional shape at the top. The square top can be received by a slot or groove, commonly referred to as a plow or dado, defined by the underside of the rail. The plow typically has a depth of about ⅛ to ¼ inch and extends along the length of the rail. Fillets typically are placed in the plow to fill the spaces in the plow between the balusters.

Depending on the type of balustrade, each of the balusters can be equal or different in length. For example, there is shown in FIG. 1 a balustrade 110 for a set of stairs 116, as is known in the art. Each stair 116 has a horizontal tread 114 and a vertical riser 115, which intersect at a front edge 120. The balustrade 110 includes square top balusters 112*a*, 112*b* that extend from the treads 114 of the stairs 116 to an inclined rail 118. Each tread 114 of each stair 116 typically includes two or more balusters 112*a*, 112*b*, as illustrated in FIG. 1. The rail 118 is disposed at a slope or angle relative to the treads 114 such that the distance between the tread and rail increases along the width of the tread. More specifically, the balusters 112*a* closest to the front edge 120 of each of the treads 114 are shorter than the balusters 112*b* closer to the riser 115 that extends vertically to the next higher tread 114. Thus, the balusters 112*a*, 112*b* of each tread 114 extend by varying distances between the tread 114 and the rail 118 and, therefore, must have different lengths.

The difference in length of the balusters 112*a*, 112*b* depends on the placement of the balusters 112*a*, 112*b*, the angle of the rail 118, and the dimensions of the treads 114 and risers 115. Building codes generally allow variations in stair sizes that can result in rail angles between about 13 and 45 degrees of inclination. Thus, square top balusters are conventionally manufactured in ten or more different lengths to accommodate the likely configurations of different balustrades. However, since the exact length required can be unique for each balustrade, at least some of the balusters are typically shortened when constructing the balustrade by removing a portion of the square top. For example, as shown in FIG. 1, each of the balusters 112*a* closest to the front edges 120 of the treads 114 has been shortened.

The need for various lengths of balusters increases the complexity and cost of manufacturing the balusters, especially for balusters having square or otherwise ornate tops. The different baluster lengths also increases the inventory cost of manufacturers, distributors, and dealers that maintain all of the available baluster sizes. In addition, the number of different baluster sizes also can increase the likelihood of errors when ordering the balusters for a balustrade.

Despite the availability of different baluster sizes, the particular dimensions of each balustrade can still require that at least some square top balusters be shortened, thereby resulting in variations in the length of the square tops and detracting from the aesthetic appeal of the balustrade. As a result, balustrades formed from square topped balusters, which are often preferred for aesthetic reasons, can be more complicated to construct than balustrades formed with pin top balusters. In addition, because the apertures used to connect pin top balusters to the rail generally have a greater depth than the plow used to secure square top balusters to the rail, square top balusters typically provide a less secure engagement with the rail than pin top balusters.

Thus, there exists a need for an improved baluster having a square or ornate top for a balustrade. The improved baluster should reduce or eliminate the need for the manufacture and storage of multiple baluster sizes. The improved baluster should also provide a secure engagement with the rail comparable with that provided by pin top balusters. Further, the improved baluster should simplify the manufacture and construction of the balustrades.

BRIEF SUMMARY OF THE INVENTION

The present invention provides a baluster with an elongate member defining a terminus portion and an end member that can receive the terminus portion of the elongate member. The terminus portion is structured to be shortened, and the end member is selectively positionable on the terminus portion, such that the baluster can accommodate stairs of varying dimensions.

According to one embodiment of the present invention, the elongate member defines a terminus portion having a predetermined length. For example, in one embodiment the length of the terminus portion is at least about 12 inches. The end member defines an aperture extending between first and second ends and configured to at least partially receive the terminus portion. The cross section of the terminus portion can vary along its length or the terminus portion can have a substantially uniform cross section. The terminus portion and the end member can have outer surfaces that generally define a cross-sectional geometry of a circle or a polygon. The elongate member can have an outer surface defining an ornate contour. The elongate member and end member can be formed of a variety of materials including, but not limited to, wood, metal, composite materials such as those formed of wood and polymers, and structural foam materials such as polystyrene. One or more annular members can be disposed on the terminus portion of each elongate member.

The present invention also provides a balustrade for stairs that includes an elongate rail supported at a predetermined slope by a plurality of the foregoing balusters. In one embodiment, the rail is supported at a slope of about 38 degrees, for example between about 36 and 39 degrees. The rail can be disposed at an angle relative to the elongate members such that at least two adjacent balusters define dissimilar lengths. Each of the end members preferably is substantially equal in length. One end of each elongate member is configured to engage the stairs. The terminus portions of the elongate members are configured to engage the rail, for example, extending into apertures or a dado defined by the rail. Additionally, or alternatively, each of the end members can engage the rail. According to one embodiment, each end member defines an oblique surface configured to contact the rail.

The present invention also provides a method of constructing a balustrade. The method includes providing at least one baluster for supporting an elongate rail. Each baluster has an elongate member and an end member. The elongate member defines a terminus portion of predetermined length. The end member defines an aperture configured to at least partially receive the terminus portion. The end member can be formed to define an oblique surface configured to contact the elongate rail. The terminus portion of the elongate member is inserted at least partially into the aperture of the end member. The end member is adjusted on the terminus portion of the elongate member so that the end member is selectively positioned thereon. According to one embodiment, the end members of at least two balusters are adjusted to different positions. The at least one baluster is secured to the elongate rail. According to one embodiment, the baluster is secured to the rail such that the rail is supported at a slope of between about 36 and 39 degrees relative to horizontal. According to another embodiment, the terminus portion is inserted through the aperture of the end member and secured to the rail, for example, by inserting the terminus portion in an aperture or dado formed in the rail. Additionally or alternatively, the end member can be engaged to the elongate rail. Further, the terminus portion of at least one of the elongate members can be cut to shorten the baluster. The method can include inserting a plurality of elongate members into end members and adjusting the end members thereon so that each end member has substantially the same length. At least one stair can be provided, and at least two of the balusters can be secured to each stair.

BRIEF DESCRIPTION OF THE SEVERAL VIEWS OF THE DRAWINGS

The foregoing and other advantages and features of the invention, and the manner in which the same are accomplished, will become more readily apparent upon consideration of the following detail description of the invention taken in conjunction with the accompanying drawings, which illustrate preferred and exemplary embodiments and which are not necessarily drawn to scale, wherein.

DETAILED DESCRIPTION OF THE INVENTION

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

Figure 1:
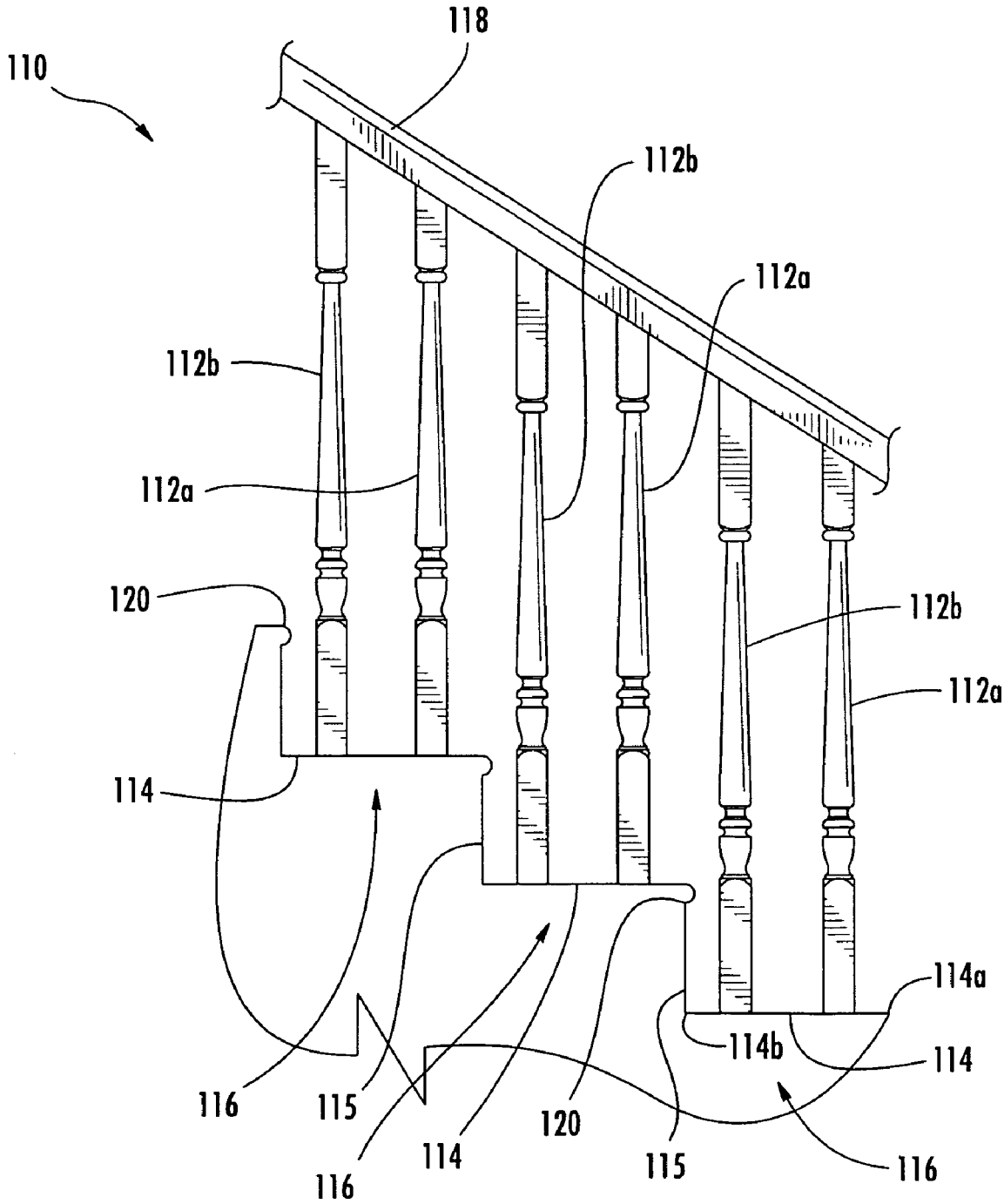
FIGURE 1 (PRIOR ART)
FIG. 1 is an elevation view illustrating a balustrade, as is known in the prior art.
Figure 2:
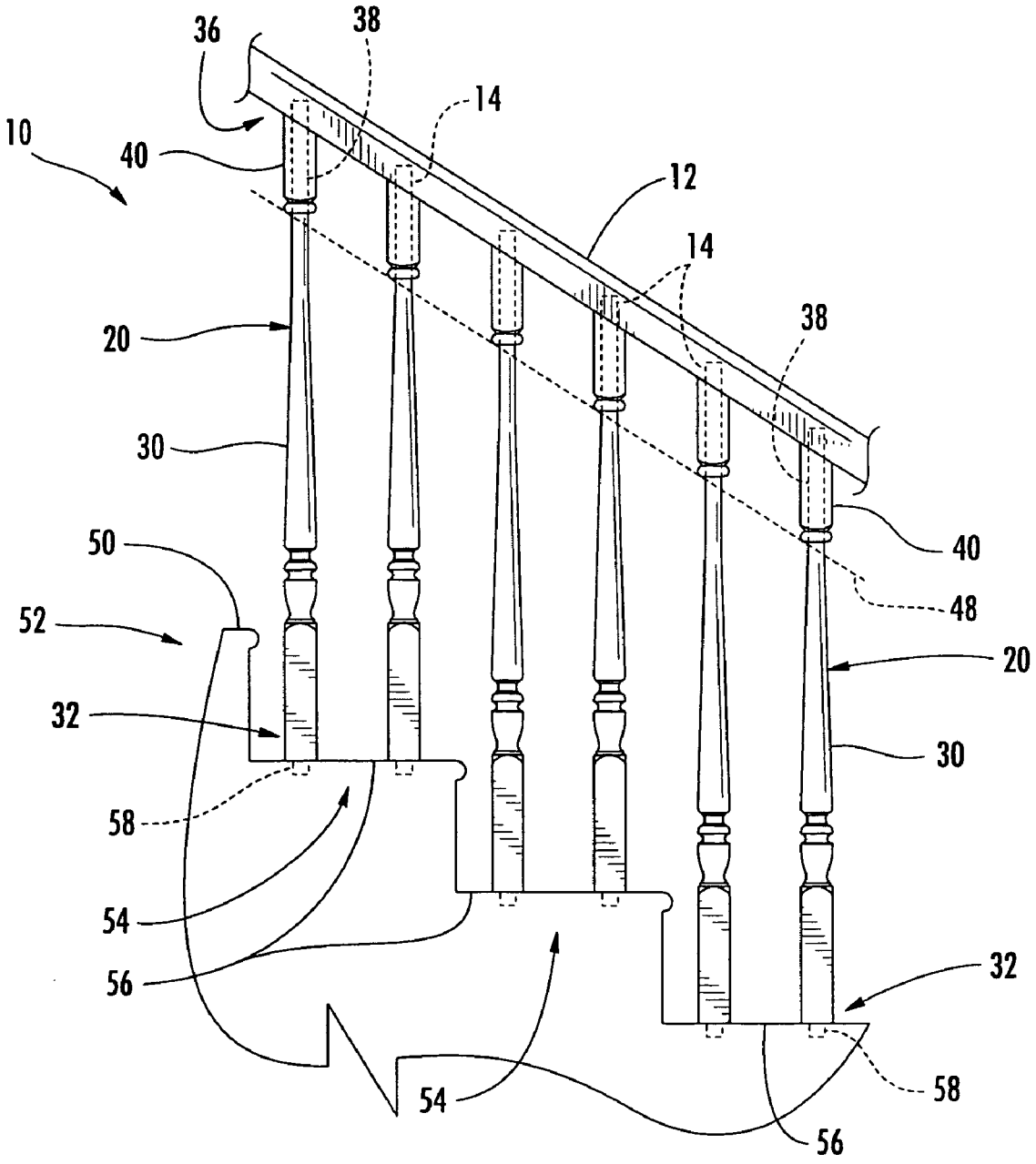
FIG. 2 is an elevation view illustrating a balustrade according to one embodiment of the present invention.

Referring to FIG. 2, there is illustrated a balustrade 10, which can be used along a staircase, balcony, veranda, ramp, or the like. The balustrade 10 includes a rail 12 that is supported by a plurality of balusters 20. The balusters 20 extend from a support surface 50, such as stairs 54 of a staircase 52, so that the rail 12 is supported relative to the support surface 50. As used herein, the term "support surface" is not limited to a single continuous surface but can refer to multiple surface portions, such as defined by the treads 56 of the stairs 54.

Figure 3:
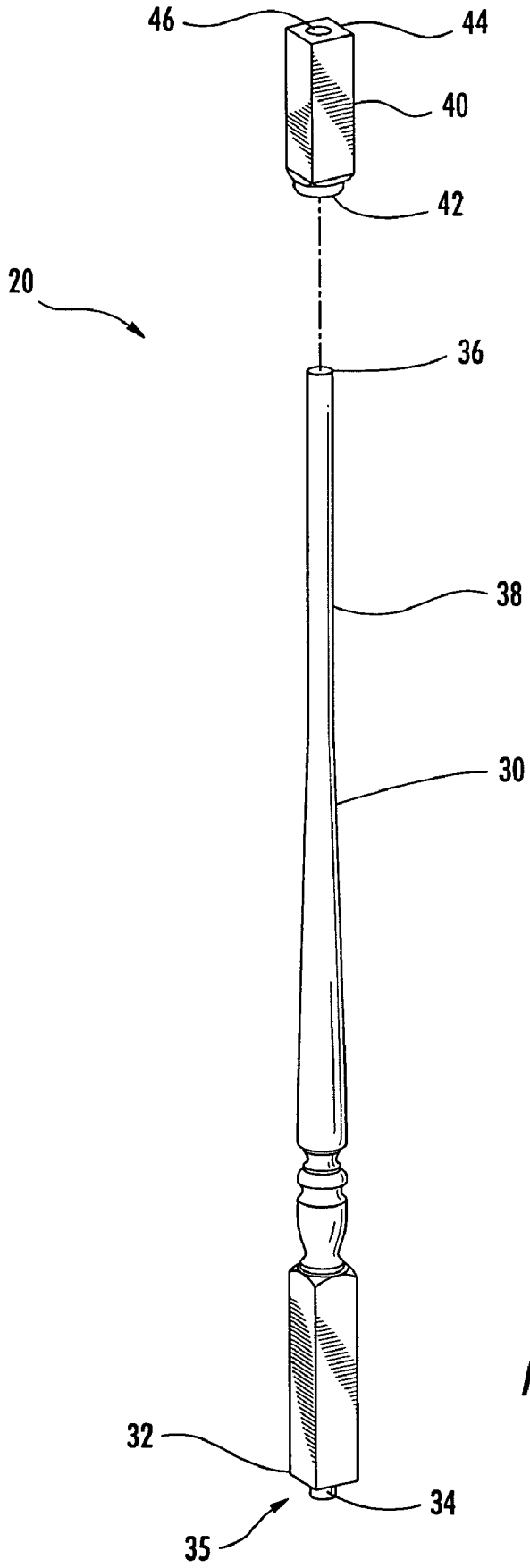
FIG. 3 is an exploded perspective view illustrating a baluster according to another embodiment of the present invention.

Each of the balusters 20 includes an elongate member 30 and an end member 40. As illustrated in FIG. 3, the elongate member 30 and the end member 40 can be formed as distinct members that are assembled when constructing the balustrade. The elongate member 30 has a first end 32 that defines a connector 35 that is configured to engage the support surface 50. For example, a pin portion 34 can extend from the elongate member 30, the pin portion 34 corresponding in diameter to apertures 58 defined by the treads 56 of the stairs 54. The pin portion 34 and the apertures 58 are illustrated with a cylindrical shape, but other shapes, such as polygonal, can similarly be used. A second end 36 of the elongate member 30, distal to the first end 32, defines a terminus portion 38. The terminus portion 38 extends a predetermined length along the elongate member 30. According to one embodiment, the terminus portion 38 extends at least 12 inches. The cross section of the terminus portion 38 can vary in shape, but preferably the terminus portion 38 has a uniform cross section.

The end member 40 has first and second ends 42, 44 and defines an aperture 46 extending from the first end 42 toward the second end 44. The aperture 46 is configured to at least partially receive the terminus portion 38 of the elongate member 30. The aperture 46 can extend partially through the end member 40 so that the terminus portion 38 can be inserted into the aperture 46 only by a distance equal to the length of the aperture 46. Alternatively, the aperture 46 can extend through the end member 40 to the second side 44, as shown in FIG. 3, so that the terminus portion 38 can be inserted therethrough. The aperture 46 preferably corresponds to the cross-sectional size and shape of the terminus portion 38. For example, as shown in FIG. 3, the terminus portion 38 and the aperture 46 can have a circular cross section. Alternatively, the terminus portion 38 and/or the aperture 46 can have other cross-sectional shapes such as polygonal.

Figure 4:
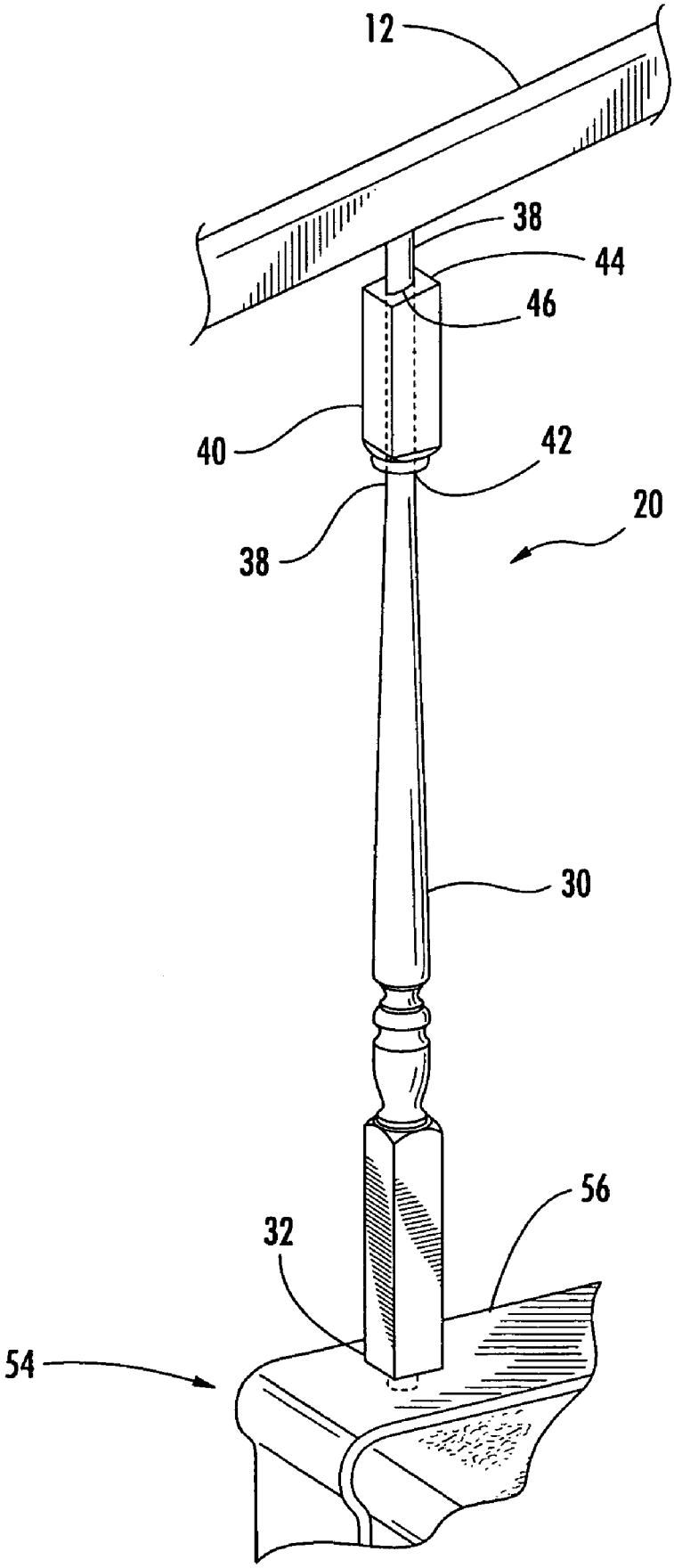
FIG. 4 is a partial perspective view illustrating the balustrade of FIG. 2 partially assembled.

As shown in FIGS. 2 and 4, the rail 12 is secured to the balusters 20 and supported thereby. For example, the rail 12 can define a plurality of apertures 14 that correspond to the size and shape of the terminus portions 38 of the elongate members 30 so that each terminus portion 38 can extend through the end member 40 of the respective baluster 20 and into one of the apertures 14 of the rail 12. Each aperture 14 can be configured to receive about 1 inch, e.g., typically 1 inch or 1¼ inches, of the terminus portion 38, and then the terminus portion 38 can be secured to the rail 12 by glue, nails, or other connection devices.

Alternatively, the rail 12 can define a slot configured to receive a portion of the end members 40 so that the end members 40 can be inserted into and secured to the rail 12. For example, a continuous plow or dado can be provided on the underside of the rail 12 for receiving end members 40 with square shaped tops. Fillets (not shown) can be inserted into the plow between successive balusters. The use of plows and fillets for securing square top balusters to a rail is well known in the art. The rail 12 can also define a plurality of apertures, similar to the apertures 14 described above, that are configured to receive the end members 40 of the balusters 20. Thus, the apertures 14 can receive the elongate members 30 and/or the end members 40 so that either or both of the elongate and end members 30, 40 can be secured to the rail 12.

The second end 44 of each end member 40 can also define an oblique surface relative to the axis of the end member 40. For example, the rail 12 can be disposed at an angle relative to the axis of the elongate member 30, the terminus portion 38 of the elongate member 30 can be secured to the rail 12, and the second end 44 of the end member 40 can define an oblique surface corresponding to the angle of inclination or slope of the rail 12, as shown in FIG. 4. The end member 40, disposed on the terminus portion 38, can be slid toward the rail 12 until the second end 44 of the end member 40 contacts the rail 12. Thus, the balustrade 10 can advantageously be configured to resemble a balustrade formed of conventional square top balusters, even though the elongate members 30 of the balusters 10 actually support the rail 12 in a manner more similar to that of conventional pin top balusters.

The terminus portion 38 of each elongate member 30 is configured to be shortened so that each baluster 20 can be shortened to a desired length as required by the particular dimensions of the balustrade 10 and the support surface 50. Thus, the elongate members 30 can be manufactured in a stock length that can be shortened, using known machining processes, before or during assembly of the balustrade 10. For example, each elongate member 30 can be manufactured with a length of about 41 inches, with the terminus portion 38 being about 13 inches. During assembly, part of the terminus portion 38 can be cut or removed so that the elongate member 30 is shortened to a predetermined length that corresponds to the length required for the desired placement of the rail 12, i.e., the distance between the support surface 50 and the rail 12. Thus, instead of shortening the balusters by removing a portion of the square portion, as is known in the art, each baluster 20 of the present invention can be shortened by removing a portion of the elongate member 30 so that the end members 40 of the different balusters 20 have substantially similar lengths.

By providing end members 40 of equal length against the rail 12, the first end 42 of successive end members 40 can be selectively aligned in successive vertical positions corresponding to the inclined angle or slope of the rail 12. The aesthetic aspect of providing end members 40 of equal length is demonstrated in FIG. 2. As shown, the two balusters 20 on each stair 54 differ in length due to the inclination or slope of the rail 12. However, the difference in length is provided by a difference in length of the elongate members 30 and, in particular, the terminus portions 38 thereof, not the length of the end members 40. Thus, the first ends 42 of the end members 40 align substantially along a plane parallel to the rail 12. For example, as shown in FIG. 2, the first ends 42 of the end members 40 are aligned along a plane referred to by reference numeral 48, the plane 48 being parallel to the rail 12. This improved aesthetic result of the balustrade 10 can be achieved regardless of the particular dimensions of the stairs 54.

Figure 5:
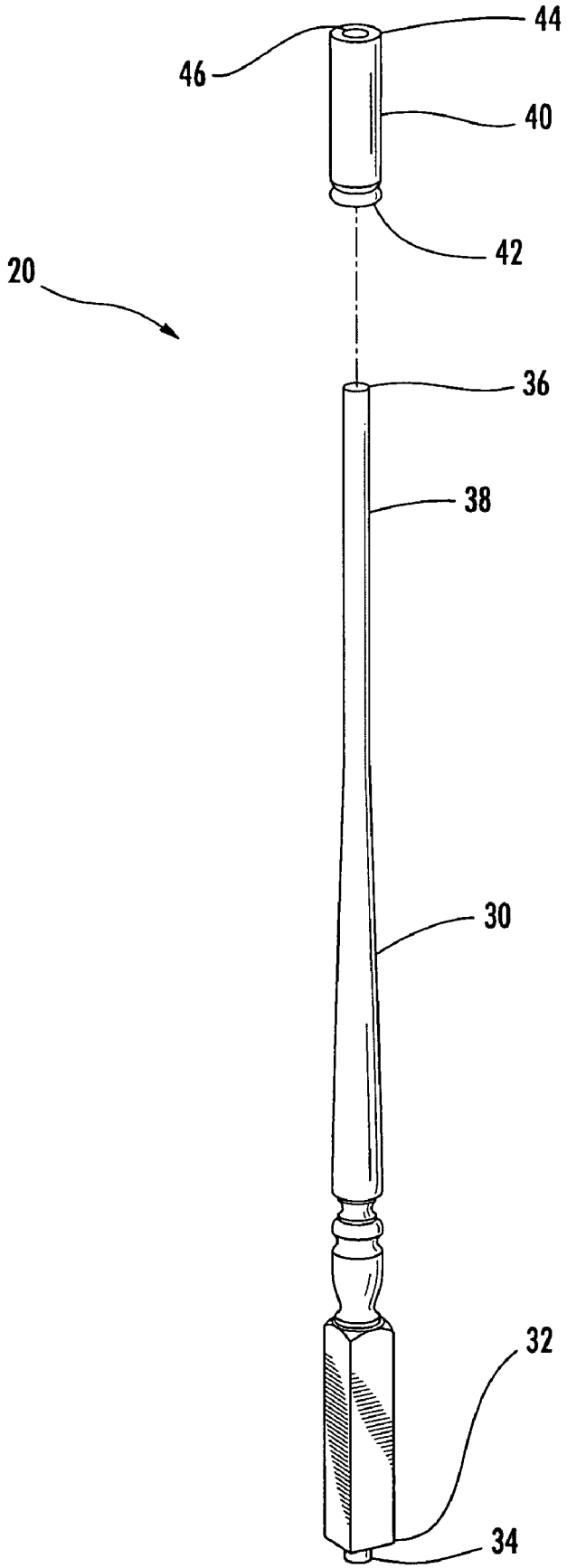
FIG. 5 is a perspective view illustrating a baluster having an end member with a generally circular cross-sectional geometry, according to another embodiment of the present invention.
Figure 6:
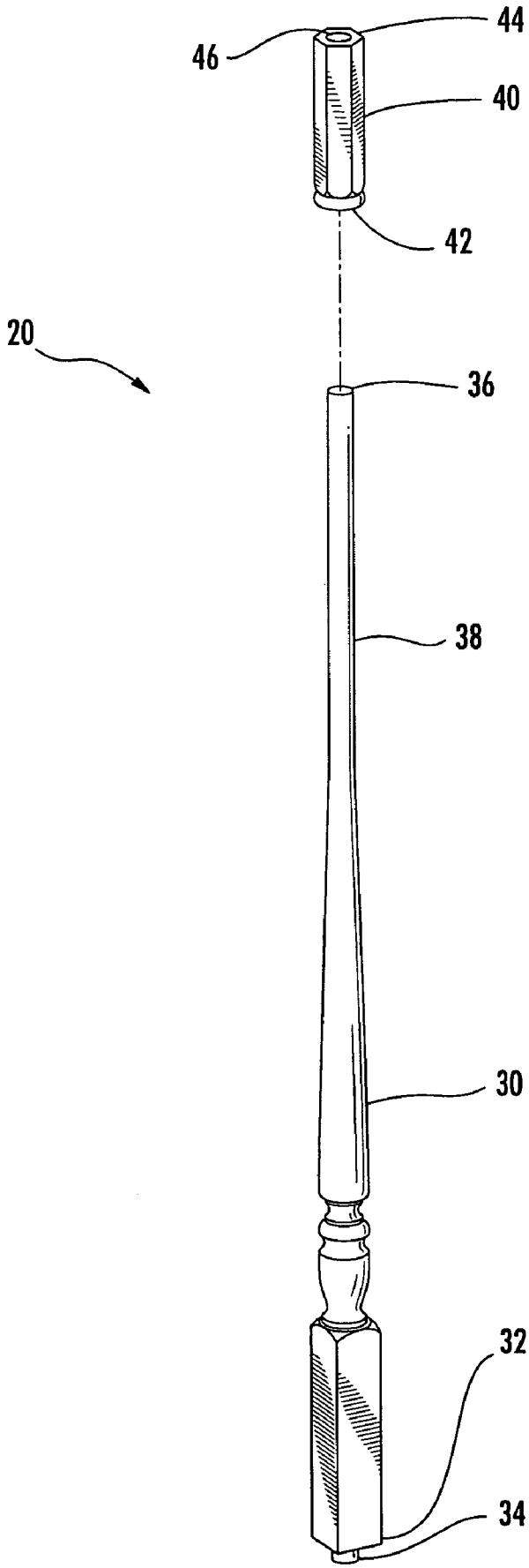
FIG. 6 is a perspective view illustrating a baluster having an end member with a generally hexagonal cross-sectional geometry, according to another embodiment of the present invention.

Each of the elongate members 30 and the end members 40 can have an outer surface that defines an aesthetic or ornate contour. For example, as shown in each of the figures, the contour can include grooves, protrusions, etchings, flat faces, and the like. Further the elongate members 30 and the end members 40 can define various cross-sectional shapes. For example, the end members 40 can have generally square, round, or hexagonal cross-sectional shapes as illustrated in FIGS. 3, 5, and 6, respectively. Alternatively, the end members 40 can define other polygonal shapes (not shown).

Figure 7:
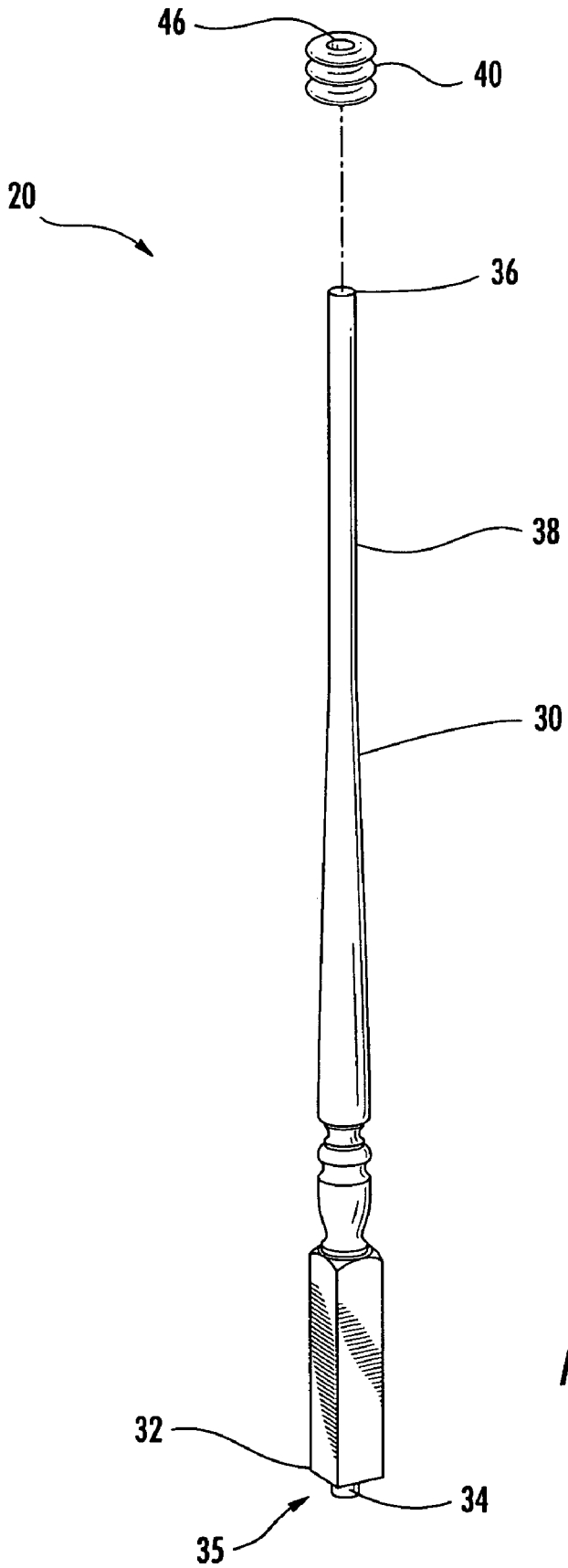
FIG. 7 is an exploded perspective view illustrating a baluster according to yet another embodiment of the present invention.
Figure 8:
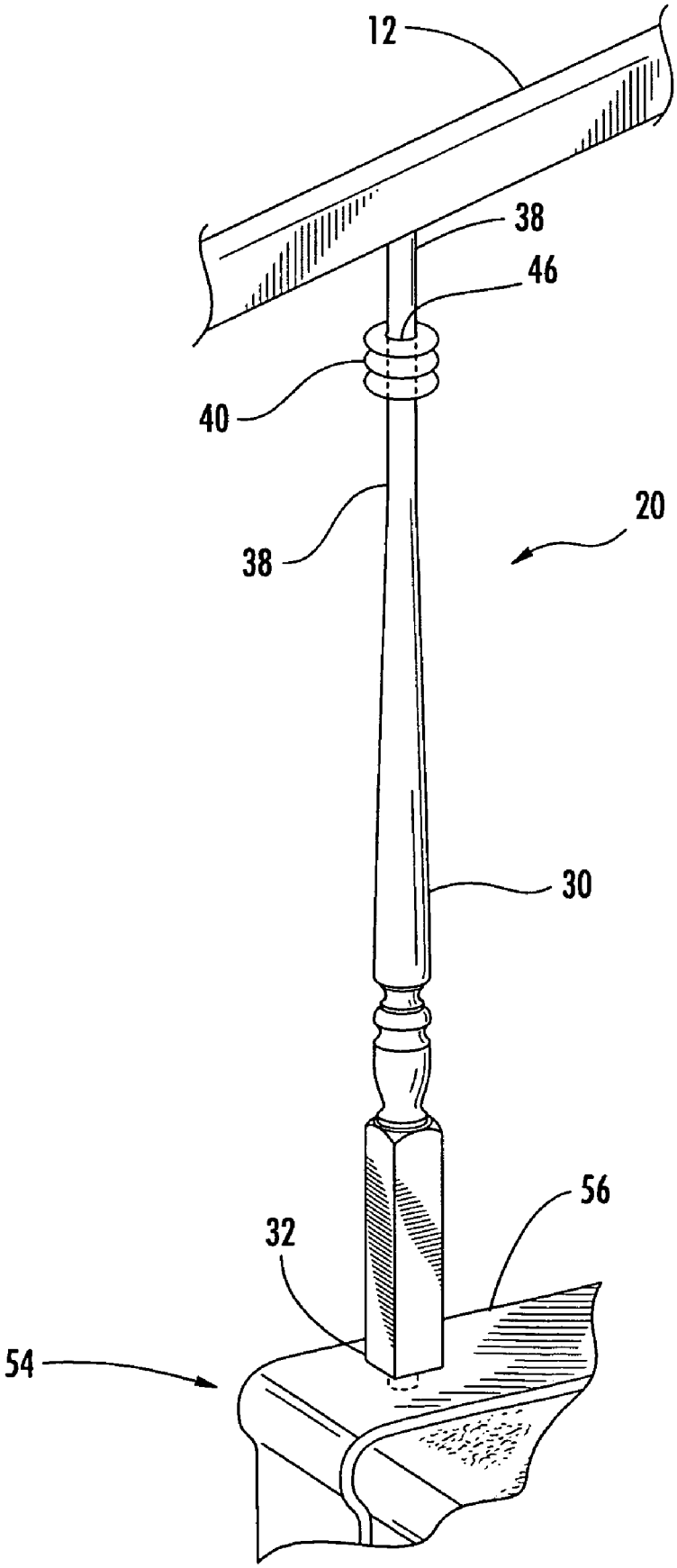
FIG. 8 is a partial perspective view illustrating a balustrade formed with the baluster of FIG. 7.

The end members 40 can also be disposed on the elongate members 30 in a spaced relationship with the rail 12 so that the end members 40 do not contact the rail 12 but instead define a space between each second end 44 and the rail 12. For example, as shown in FIGS. 7 and 8, each end member 40 can be adjusted to a desired position along the length of the respective elongate member 30. Thus, the second ends 44 of the end members 40 can be disposed at substantially similar distances from the rail 12 so that the first ends 42 of the end members 40 align substantially along a plane that is parallel to the rail 12.

Figure 9:
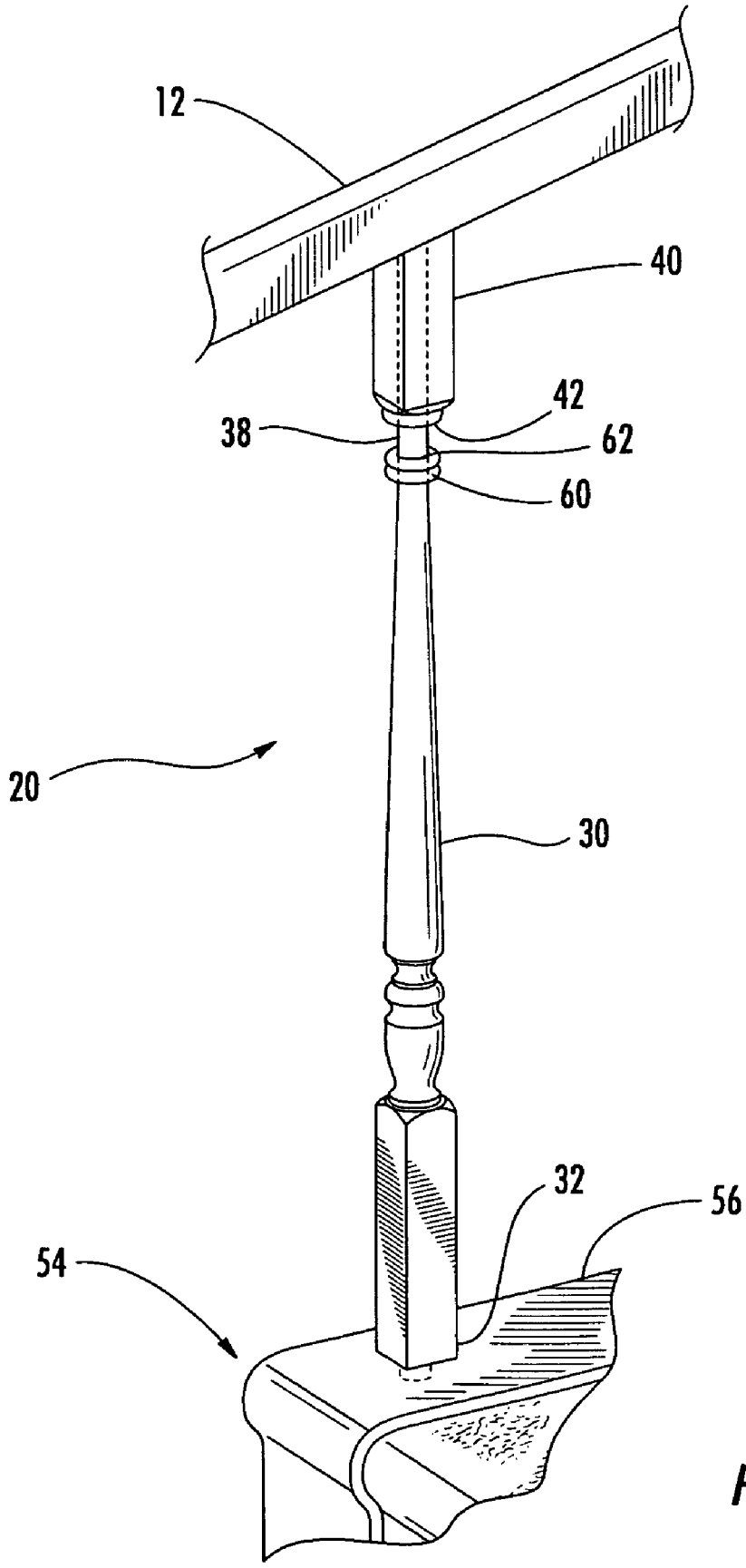
FIG. 9 is a perspective view illustrating a baluster having an annular member disposed thereon.

An annular member 60 can also be disposed on the elongate member 30, as shown in FIG. 9. The annular member 60, which can be formed separately from the elongate member 30, defines an aperture 62 that corresponds to the terminus portion 38 of the elongate member 30. The annular member 60 can be disposed on the terminus portion 38 and affixed thereto, for example, by gluing or nailing. Further, the annular members 60 can be adjusted to desired positions along the length of each elongate member 30 so that the annular members 60 are disposed at substantially similar distances from the first ends 42 of the end members 40. According to this configuration, the annular members 60 thereby align substantially along a plane that is parallel to the rail 12. An outer contour defined by the annular members 60 can provide an additional aesthetic aspect to the balusters 20. The outer contour of the annular members 60 can complement the contour of the end members 40. Further, the end member 40 can comprise the annular member 60, and, in some embodiments, the annular members 60 and end members 40 can be used interchangeably.

The present invention also provides a method of constructing a balustrade 10. According to one embodiment, the elongate member 30 of each baluster 20 is provided in a stock length, with the terminus portion 38 having a predetermined length. The elongate member 30 is shortened by cutting or removing a portion of the terminus portion 38 so that the baluster 20 corresponds to a desired length between the support surface 50 and the rail 12. The second end 44 of the end member 40 can be cut or machined to an oblique angle and thereby configured to contact the rail 12. The elongate member 30 is secured to the support surface 50. If the support surface 50 is a set of stairs 54, two or more of the elongate members 30 can be supported on each tread 56 of the stairs 54. The terminus portion 38 of each elongate member 30 is inserted at least partially into the aperture 46 of the end member 40. If the aperture 46 extends through the end member 40, the terminus portion 38 can be extended through the aperture 46 and secured to the rail 12. For example, an aperture 14 can be formed in the rail 12 and the terminus portion 38 inserted therein. The rail 12 can be disposed at an angle or slope, for example, between about 36 and 39 degrees or, more particularly, about 38 degrees relative to horizontal, i.e., the direction perpendicular to the axis of the balusters 20, and secured to the elongate members 30. The end member 40 is then selectively adjusted on the terminus portion 38 to a desired position. For example, in one embodiment, the end member 40 is selectively adjusted so that the second end 44 thereof is flush against the rail 12. Alternatively, the end member 40 can be inserted into the aperture 14 or otherwise secured to the rail 12, in which case the terminus portion 38 and/or the aperture 46 can extend only partially through the end member 40. In either case, the end members 40 of different balusters 20 can be adjusted to different positions on the terminus portions 38 of the respective elongate members 30, and are preferably adjusted so that the first ends 42 align substantially along a plane parallel to the rail 12.

Figure 10:
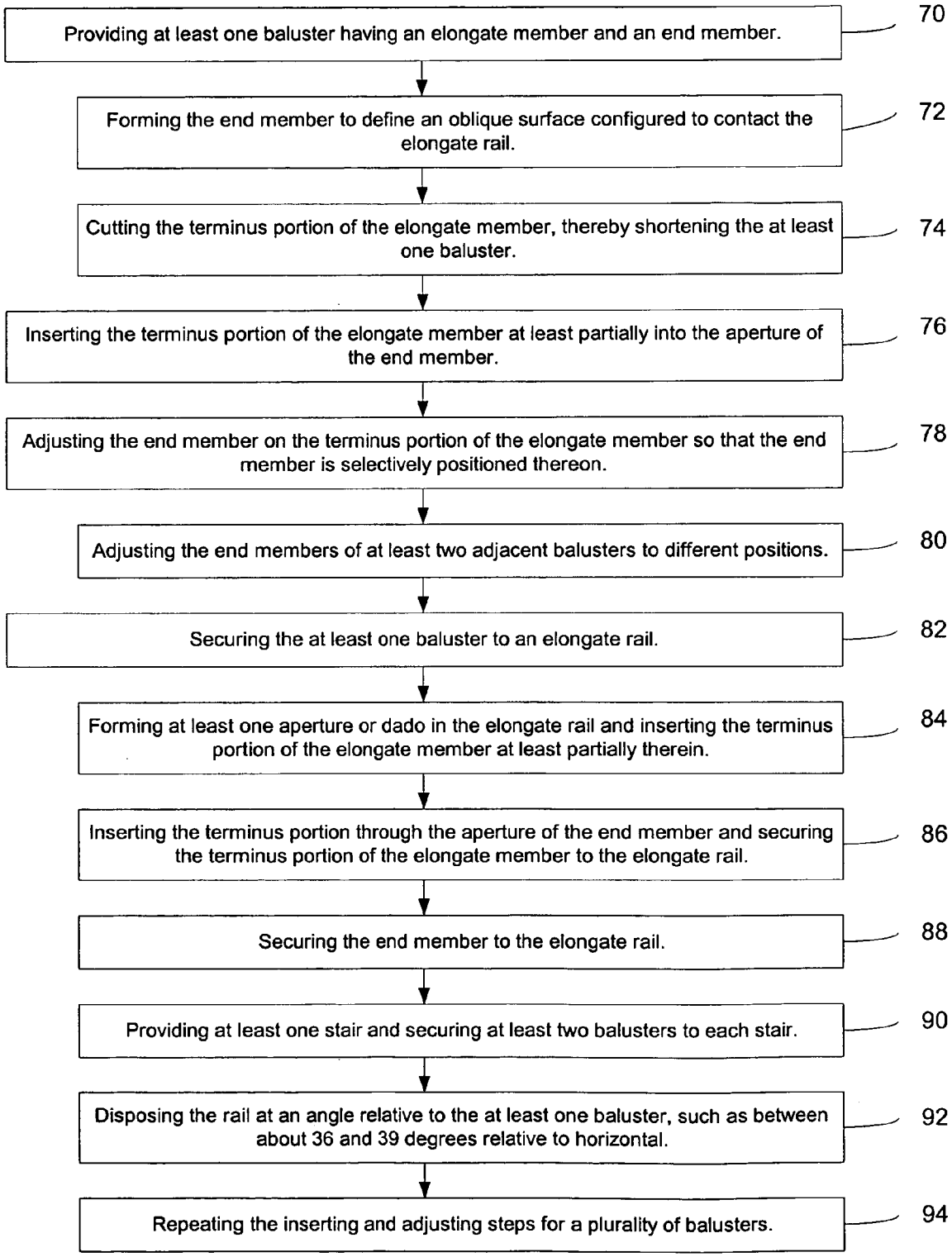
FIG. 10 is a flow chart illustrating the operations performed in constructing a balustrade according to one embodiment of the present invention.

FIG. 10 illustrates the operations for constructing a balustrade according to one embodiment of the present invention. It is understood that one or more of the operations illustrated in FIG. 10 can be omitted. The method includes providing at least one baluster, each baluster having an elongate member and an end member. See Block 70. The end member can be formed to define an oblique surface configured to contact an elongate rail. See Block 72. Additionally, the terminus portion of each elongate member can be cut to shorten the baluster. See Block 74. The terminus portion of the elongate member is inserted at least partially into the aperture of the end member. See Block 76. The end member is adjusted on the terminus portion so that the end member is selectively positioned thereon. See Block 78. The end members of at least two adjacent balusters can be adjusted to different positions. See Block 80. The balusters are secured to the elongate rail. See Block 82. For example, one or more apertures or dados can be formed in the rail and the terminus portion can be inserted therein. See Block 84. The terminus portion can be inserted through the aperture of the end member and secured to the rail. See Block 86. Additionally or alternatively, the end member can be secured to the rail. See Block 88. One or more stairs can be provided, and at least two balusters can be secured to each of the stairs. See Block 90. The rail can be disposed at an angle relative to each baluster. See Block 92. Further, the inserting and adjusting steps of the method can be repeated for a plurality of balusters. See Block 94.

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A method of constructing a balustrade, comprising:

providing at least one baluster, each baluster having an elongate member and an end member, the elongate member defining a terminus portion of predetermined length, the end member defining an aperture;

inserting the terminus portion of the elongate member through the aperture of the end member;

adjusting the end member on the terminus portion of the elongate member so that the end member is selectively positioned thereon; and inserting and securing the terminus portion of the elongate member of each baluster directly into an aperture defined by an elongate rail, the aperture defined by the elongate rail having cross-sectional dimensions corresponding to the cross-sectional dimensions of the terminus portion inserted therein such that the terminus portion is received therein with a substantially frictional fit.

2. A method according to claim 1 wherein said securing step comprises disposing the rail at an angle relative to at least two of the balusters.

3. A method according to claim 1 wherein said adjusting step comprises adjusting the end members of at least two adjacent balusters to different positions.

4. A method according to claim 1 wherein said adjusting step comprises adjusting the end members to define a space between the end members and the elongate rail.

5. A method according to claim 1 further comprising forming the end member to define an oblique surface configured to contact the elongate rail.

6. A method according to claim 1 further comprising forming a plurality of the apertures in the elongate rail.

7. A method according to claim 1 further comprising forming at least one dado in the elongate rail and wherein said securing step comprises inserting the terminus portion of the elongate member at least partially into the at least one dado of the elongate rail.

8. A method according to claim 1 wherein said securing step comprises securing the end member to the elongate rail.

9. A method according to claim 1 wherein said securing step comprises disposing the elongate rail at an angle of about between about 36 and 39 degrees relative to horizontal.

10. A method according to claim 1 further comprising:

providing at least one stair; and securing at least two balusters to each stair.

11. A method according to claim 1 further comprising cutting the terminus portion of the elongate member, thereby shortening the at least one baluster.

12. A method according to claim 1 further comprising repeating said inserting and adjusting steps for a plurality of balusters.

* * * * *